US008904845B2

(12) United States Patent
Su

(10) Patent No.: US 8,904,845 B2
(45) Date of Patent: Dec. 9, 2014

(54) METHOD FOR MANUFACTURING A DAMPING SHAFT SLEEVE

(71) Applicant: Extend Forming Industrial Corp., Kaohsiung (TW)

(72) Inventor: Johnson Su, Kaohsiung (TW)

(73) Assignee: Extend Forming Industrial Corp., Kaohsiung (TW)

( * ) Notice: Subject to any disclaimer, the term of this patent is extended or adjusted under 35 U.S.C. 154(b) by 0 days.

(21) Appl. No.: 14/043,211

(22) Filed: Oct. 1, 2013

(65) Prior Publication Data

US 2014/0090440 A1 Apr. 3, 2014

(30) Foreign Application Priority Data

Oct. 3, 2012 (TW) ..... 101136537 A

(51) Int. Cl.
*B21K 1/26* (2006.01)
*B21D 22/00* (2006.01)
*B21J 5/02* (2006.01)

(52) U.S. Cl.
CPC ..... *B21J 5/02* (2013.10)
USPC ..... 72/358; 72/352; 72/354.6; 72/355.4; 72/359; 29/898.048

(58) Field of Classification Search
USPC ..... 72/352, 354.6, 355.2, 355.4, 356, 357, 72/358, 359, 370.06; 29/898.048
See application file for complete search history.

(56) References Cited

U.S. PATENT DOCUMENTS

| | | | | |
|---|---|---|---|---|
| 4,217,771 | A * | 8/1980 | Braun | 72/358 |
| 4,352,283 | A * | 10/1982 | Bailey | 72/355.2 |
| 6,447,399 | B1 * | 9/2002 | Denham | 72/370.06 |
| 6,701,768 | B2 * | 3/2004 | Ling et al. | 72/356 |
| 7,055,359 | B2 * | 6/2006 | Liu | 72/357 |
| 7,080,539 | B2 * | 7/2006 | Parker | 29/898.048 |

* cited by examiner

*Primary Examiner* — David B Jones
(74) *Attorney, Agent, or Firm* — Whyte Hirschboeck Dudek S.C.

(57) ABSTRACT

This invention relates to a method for manufacturing a damping shaft sleeve that includes: forging a base material into a billet that includes a cylindrical body having two opposite ends and an annular flange formed on one of the opposite ends; forging a shaft hole in the cylindrical body; inverting the base material and forming two annular grooves that are respectively indented from two opposite surfaces of the annular flange; forging the billet to form the annular flange into a bottom wall and a side wall, the bottom wall cooperating with the side wall to form an asymmetrical and helical groove; and forging the shaft hole to pass through the cylindrical body of the billet.

7 Claims, 3 Drawing Sheets

METHOD FOR MANUFACTURING A DAMPING SHAFT SLEEVE

CROSS-REFERENCE TO RELATED APPLICATION

This application claims priority of Taiwanese Application No. 101136537, filed on Oct. 3, 2012.

BACKGROUND OF THE INVENTION

1. Field of the Invention

The invention relates to a method for manufacturing a shaft sleeve, more particularly to a method for manufacturing a damping shaft sleeve.

2. Description of the Related Art

With reference to FIG. 1, a conventional damping shaft sleeve 1 generally includes a shaft tube 11, a bottom wall 12 that extends radially outward from one end of the shaft tube 11, and a surrounding wall 13 that extends from the bottom wall 12 and that surrounds the shaft tube 11. The bottom wall 12 and the surrounding wall 13 cooperate to define a substantially asymmetrical and annular groove 14. The conventional damping shaft sleeve 1 is adapted to be sleeved around a shaft (not shown) so as to reduce power loss of the shaft during power transmission as caused by vibration-induced belt jumping.

Initially, the conventional method for manufacturing the conventional damping shaft sleeve 1 is primarily based on turning or milling techniques. However, such method has a relatively low production rate and generates excessive waste material, resulting in a relatively high production cost. Hence, such method has been gradually replaced with a method based on forging techniques.

Referring to FIG. 2, the conventional method for manufacturing a damping shaft sleeve based on the forging techniques sequentially includes a preparing step 21, a base material-forming step 22, a billet-forming step 23, a pre-forming step 24, an annular groove-forming step 25, and a refining step 26. In the preparing step 21, a cylinder bar of the raw material 31 is prepared. In the base material-forming step 22, a base material 32 is formed by forging the raw material 31 that has been subjected to a first annealing and acid-cleaning treatment. The base material 32 has a bell-shaped body 321 and a groove 322 formed at the top of the bell-shaped body 321. In the billet-forming step 23, a billet 33 is formed by forging the base material 32 that has been subjected to a second annealing and acid-cleaning treatment and then inverted so that the groove 322 faces downwards. The billet 33 has a small diameter portion 331 that has two opposite ends, two grooves 332 that are respectively formed at the two opposite ends of the small diameter portion 331, and an annular flange 333 that surrounds and extends outward from one of the opposite ends of the small diameter portion 331. In the pre-forming step 24, the grooves 332 of the billet 33 are shaped and reamed. In the groove-forming step 25, an asymmetrical annular groove 14 that has an uneven depth is formed in the annular flange 333 of the billet 33 by a third annealing and acid-cleaning treatment. Finally, in the refining step 26, the grooves 332 on the small diameter portion 331 of the billet 33 are made to communicate with each other so as to form a through hole that extends through the small diameter portion 331 and that has a hexagonal (or toothed) cross-section.

In view of the foregoing, the conventional method for manufacturing the conventional damping shaft sleeve 1 involves multiple annealing treatments, multiple acid-cleaning treatments and multiple forging processes that have to be carried out after the material to be forged is molten. Each of the annealing treatments requires heating of the material, maintaining the temperature of the material and so on, and the acid-cleaning treatment for removing oxide layers formed in the annealing treatment. Thus, the annealing treatments, the acid-cleaning treatments, and subsequent waste water treatment consume much time, energy and money, and there is room for improvement.

SUMMARY OF THE INVENTION

Therefore, the object of the present invention is to provide a method for manufacturing a damping shaft sleeve that can overcome the aforesaid drawbacks of the prior art so as to reduce the number of annealing and acid-cleaning treatments, to increase the production rate and to have an improved efficiency without incurring environmental concerns.

Accordingly, a method for manufacturing a damping shaft sleeve includes: (a) forging abase material into a billet that includes a cylindrical body having a first end and a second end opposite the first end, and an annular flange disposed on the first end of the cylindrical body; (b) forging the cylindrical body to form a shaft hole that extends from the first end to the second end in a lengthwise direction of the cylindrical body and that is blind; (c) inverting the base material and forming two annular grooves that are respectively indented from two opposite surfaces of the annular flange and that extend in the lengthwise direction of the cylindrical body; (d) forging the billet to form the annular flange into a bottom wall that is connected to the first end of the cylindrical body and that has a rugged surface facing the second end of the cylindrical body, and a side wall that extends from the bottom wall toward the second end of the cylindrical body in the lengthwise direction, the bottom wall cooperating with the side wall to form an asymmetrical and helical groove; and (e) forming the shaft hole to extend through the cylindrical body of the billet.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
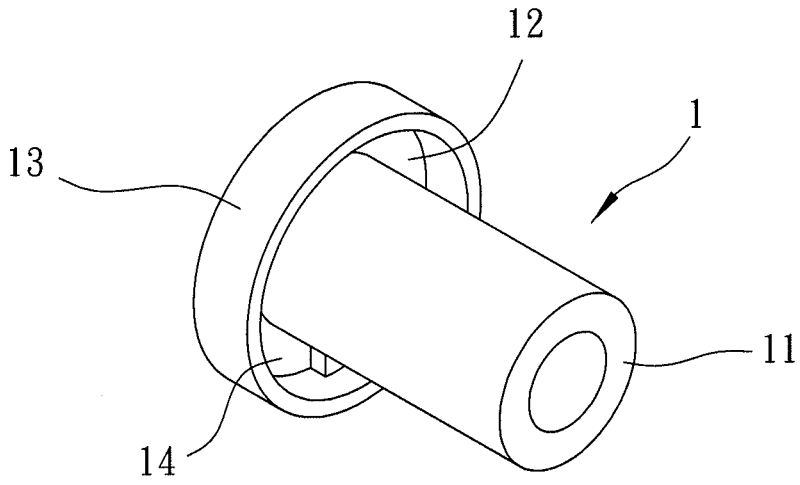
FIG. 1 PRIOR ART
FIG. 1 is a perspective view to illustrate a conventional damping shaft sleeve.
Figure 2:
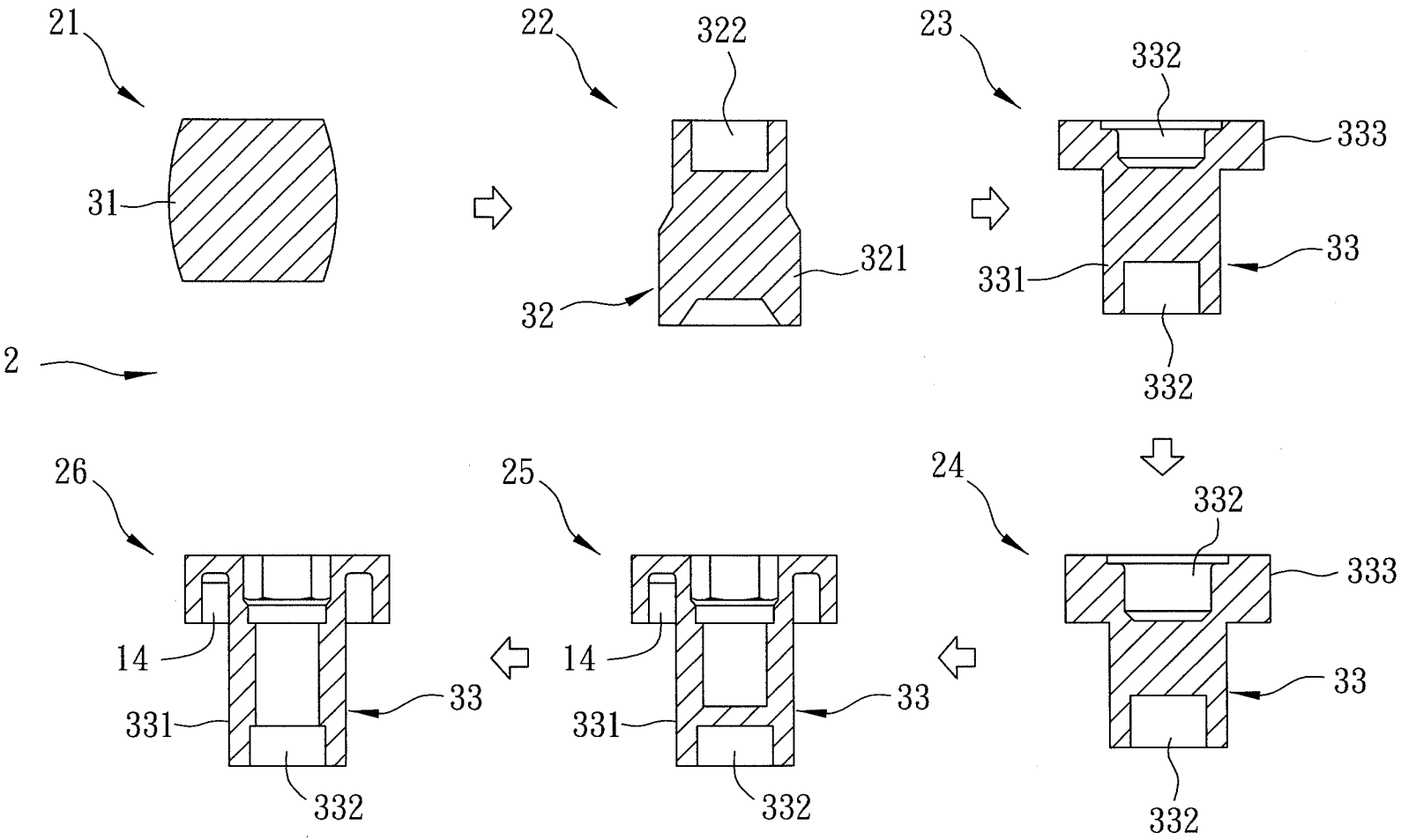
FIG. 2 PRIOR ART
FIG. 2 is a schematic view to illustrate the consecutive steps of a conventional method for forging the conventional damping shaft sleeve of FIG. 1.
Figure 3:
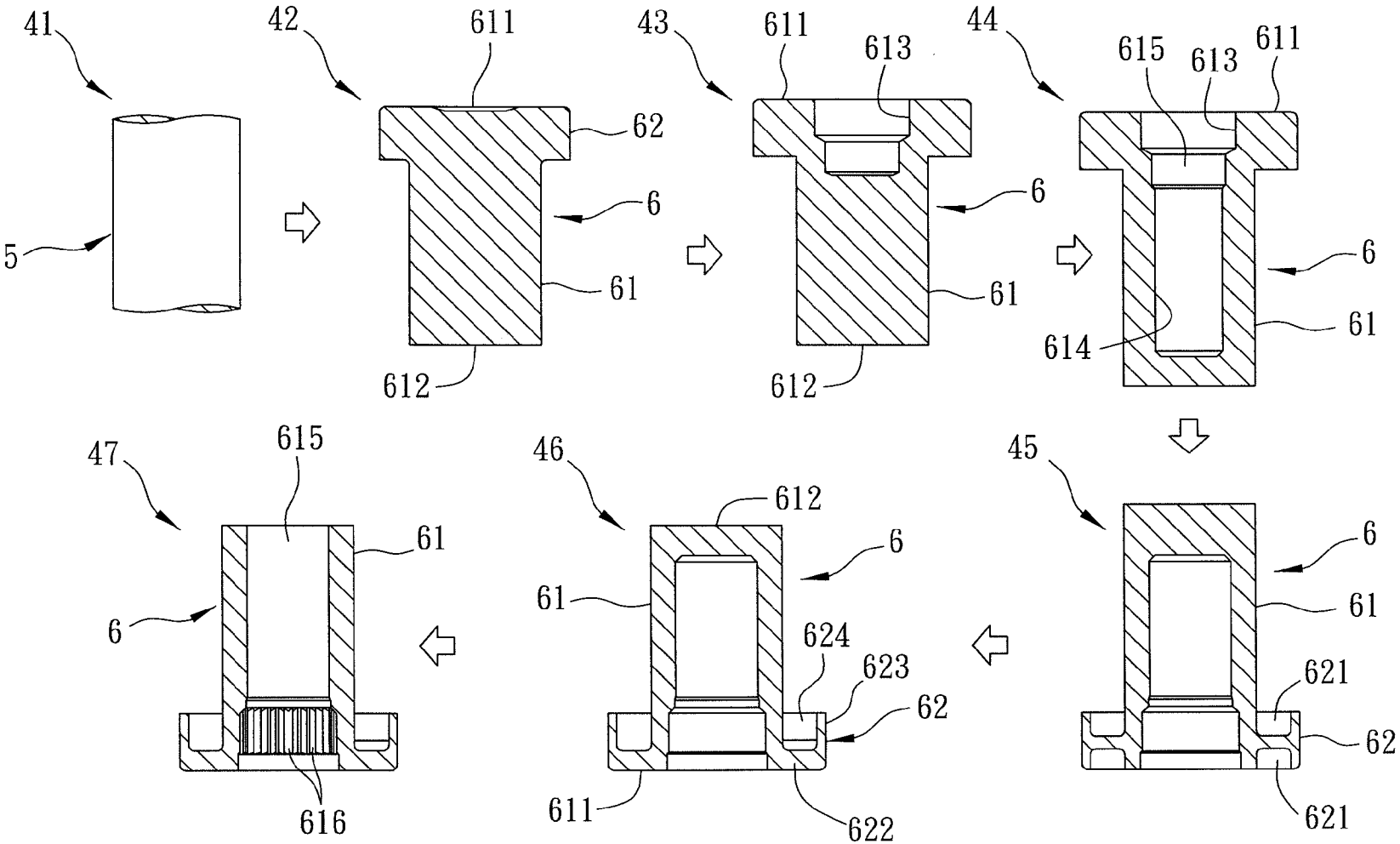
FIG. 3 is a schematic view to illustrate the consecutive steps of the preferred embodiment of a method for manufacturing a damping shaft sleeve according to the present invention.

FIG. 3 illustrates the preferred embodiment of the method for manufacturing a damping shaft sleeve of the present invention.

In step 41, a cylindrical base material 5 is prepared by automatic blanking techniques from a wire rod. Although the base material 5 used in this embodiment is made from carbon steel, which is a kind of structural steels, other alloy steels may be used for making the cylindrical base material 5.

In step 42, a billet 6 is forged from the base material 5 using a mold. The billet 6 includes a cylindrical body 61 that has opposite first and second ends 611, 612 and an annular flange 62 that extends from and surrounds the first end 611 of the cylindrical body 61.

Subsequently, the cylindrical body 61 is forged to form a shaft hole 615 that extends from the first end 611 toward the second end 612 in a lengthwise direction of the cylindrical body 61 and that is blind. Preferably, as shown in step 43, a first recessed portion 613 that is indented from the first end 611 of the cylindrical body 61 and that extends toward the second end 612 of the cylindrical body 61 is forged, and as shown in step 44, a second recessed portion 614 is forged in the cylindrical body 61 and extends from the first recessed portion 613 toward the second end 612. The first recessed portion 613 and the second recessed portion 614 cooperate with each other to define the blind shaft hole 615.

In step 45, the billet 6 is inverted and two annular grooves 621 are formed to be respectively indented from two opposite surfaces of the flange 62 and extend in the lengthwise direction of the cylindrical body 61.

Formation of these annular grooves 621 are the essential feature of the method of this invention. Based on the principle that every action has an equal and opposite reaction, it is possible to perform cold forging on the hard billet 6. These annular grooves 621 are pre-formed for a bottom wall 622 and an asymmetrical and helical groove 624, and significantly reduce the resistance against continual deformation based on the principle of dislocation, thus allowing for cold forging of the high-strength billet 6 to generate the groove 624.

In step 46, the billet 6 is cold forged to form the flange 62 into the bottom wall 622 that is connected to the first end 611 and that has a rugged surface facing the second end 612 of the cylindrical body 61, and a side wall 623 that extends from the bottom wall 622 toward the second end 612 in the lengthwise direction. The side wall 623 and the bottom wall 622 cooperate to define the asymmetrical and helical groove 624.

The asymmetrical and helical groove 624 receives a biasing member (not shown), such as a spring, such that when a power transmission belt (not shown) is driven and there are vibrations or noises caused by conventional mechanisms, the asymmetric and helical shape of the groove 624 unevenly presses against the spring, causing the spring to stretch and compress unevenly, thereby absorbing the vibrations, negating the effect that the vibrations would have had on the ability to transmit power from a drive shaft (not shown) to a shaft (not shown), and preventing noise.

In step 47, the shaft hole 615 of the billet 6 is formed to extend through the cylindrical body 61 and a plurality of toothed grooves 616 are formed in an inner surface of the first end 611 of the cylindrical body 61. The shaft hole 615 is capable of accommodating the drive shaft and the toothed grooves 616 are complementary to the drive shaft. The configuration of the inner surface of the first end 611 is not limited to having the toothed grooves 616 and may be replaced by a conventional configuration having a hexagonal or octagonal cross-section.

Each forging step performed in the method of the present invention contains various modifications upon the prior art, especially in step 45 when forming the two annular grooves 621 in the flange 62 to significantly reduce the flow stress for forming the groove 624 in step 46. Thus, in this embodiment, the annealing treatment is not required in order to perform each of the forging operations, thereby reducing energy consumption, wear on the material, and manufacture time.

To sum up, the most important step in the method of manufacturing a damping shaft sleeve of the present invention is step 45, in which two annular grooves 621 are formed in the flange 62. These annular grooves 621 reduce the flow stress when forming the groove 624 and negate the need for annealing in step 46. Not only can the energy consumption be reduced, but the manufacture time can also be decreased, thereby accomplishing the goals of this invention.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A method for manufacturing a damping shaft sleeve comprising:

(a) forging a base material into a billet that includes a cylindrical body which has a first end and a second end opposite the first end, and an annular flange which extends from and surrounds the first end of the cylindrical body;

(b) forging the cylindrical body to form a shaft hole that extends from the first end toward the second end in a lengthwise direction of the cylindrical body and that is blind;

(c) inverting the base material and forming two annular grooves that are respectively indented from two opposite surfaces of the flange and that extend in the lengthwise direction of the cylindrical body;

(d) forging the billet to form the flange into a bottom wall that is connected to the first end of the cylindrical body and that has a rugged surface facing the second end of the cylindrical body, and a side wall that extends from the bottom wall toward the second end of the cylindrical body in the lengthwise direction, the bottom wall cooperating with the side wall to form an asymmetrical and helical groove; and (e) forming the shaft hole to extend through the cylindrical body of the billet.

2. The method of claim 1, wherein the step of forging the cylindrical body to form the shaft hole includes forging a first recessed portion that is indented from the first end of the cylindrical body and that extends toward the second end of the cylindrical body in the lengthwise direction, and forging a second recessed portion that extends from the first recessed portion toward the second end; and wherein the first recessed portion and the second recessed portion cooperate with each other to define the shaft hole.

3. The method of claim 1, wherein the base material is made from carbon steel.

4. The method of claim 1, wherein the base material is form from alloy steel.

5. The method of claim 1, further comprising forming a plurality of toothed grooves in an inner surface of the first end of the cylindrical body.

6. The method of claim 1, further comprising forming an inner surface of the first end of the cylindrical body into having a hexagonal cross-section.

7. The method of claim 1, further comprising forming an inner surface of the first end of the cylindrical body into having an octagonal cross-section.

* * * * *